US005088126A

United States Patent [19]

Mathis

[11] Patent Number: 5,088,126

[45] Date of Patent: Feb. 18, 1992

[54] DISPOSABLE LINER FOR PROTECTIVE HEAD COVERINGS

[76] Inventor: Richard M. Mathis, 110 South 400 East, Vernal, Utah 84078

[21] Appl. No.: 514,979

[22] Filed: Apr. 26, 1990

[51] Int. Cl.[5] ..... A42C 5/02

[52] U.S. Cl. ..... 2/181; 2/181.4; 2/190; 2/DIG. 11

[58] Field of Search ..... 2/63, 181, 181.4, 182.2, 2/182.4, 185 R, 190, 199, 60, DIG. 11, 171

[56] References Cited

U.S. PATENT DOCUMENTS

| | | | |
|---|---|---|---|
| 2,042,567 | 6/1936 | Trieschmann | 2/60 |
| 2,994,090 | 8/1961 | Ostwald | 2/182.1 |
| 3,578,736 | 5/1971 | Dootson | 2/181 |
| 4,274,157 | 6/1981 | Boden | 2/197 |
| 4,653,119 | 3/1987 | Kaiser | 2/60 |
| 4,747,164 | 5/1988 | Foulke | 2/171 |
| 4,941,210 | 7/1990 | Konucik | 2/181.4 |

FOREIGN PATENT DOCUMENTS

| | | | |
|---|---|---|---|
| 260533 | 11/1926 | United Kingdom | 2/181 |

*Primary Examiner*—Werner H. Schroeder
*Assistant Examiner*—Diana L. Biefeld
*Attorney, Agent, or Firm*—Mallinckrodt & Mallinckrodt

[57] ABSTRACT

A disposable liner to be placed inside a hard hat, or similar protective head covering, so as to be in direct contact with a wearer's forehead. The liner is formed of an absorbent material such as terry cloth which has a pressure sensitive adhesive on one side thereof. The adhesive removeably secures the liner to the normal forehead contacting flap of the hard hat. The liner absorbs sweat, cushions from minor protrusions, and insulates from cold temperatures.

20 Claims, 2 Drawing Sheets

DISPOSABLE LINER FOR PROTECTIVE HEAD COVERINGS

BACKGROUND OF THE INVENTION

1. Field

The present invention relates generally to the use of safety equipment and more specifically to the forehead contacting portions of the supporting headgear of a hard hat or similar head protection.

2. State of the Art

Hard hats are well known in construction, manufacturing and many other industries. Standard hard hats comprise a metal or hard plastic shell, which generally conforms to the shape of a wearer's head; and supporting headgear therein which forms a suspension system attached to the inner concave portion of the shell, and which is fitted to and supports the shell on the wearer's head. Various other types of head protection such as welding helmets and face shields have similar headgear.

The headgear or suspension system is usually made up of a number of flexible straps to fit over the head inside the shell and a strap which fits snugly about the circumference of the head extending across the forehead and around the back of the head. Normally, a flap or covering of soft plastic with a foam material is placed between the plastic strap and the wearer's forehead to provide some cushion and make the headgear more comfortable to wear.

While the above-described hard hat or other head protection is quite effective in terms of safety and utility, it has been found lacking in comfort. For example, many who wear hard hats on a consistent basis must do so in less than ideal temperature environments. Steel workers often work under extremely high temperature conditions, while construction workers must face high temperatures outdoors in the summer or in hot climates and extremely low temperatures when working outdoors during winter in cold climates. Because the soft plastic used in the flap portion of the headgear which contacts the wearer's forehead is non-porous, non-absorbent, and a poor insulator, it cannot absorb sweat or insulate from the cold. As a result, the wearer suffers discomfort.

An additional source of discomfort may be a flap's limited ability to cushion the forehead from irregularities in the otherwise smooth surface of the enclosed or covered strap. When a hard hat must be worn for hours at a time, even the slightest protrusion can be detected and cause much discomfort. Often, slight protrusions are built into the enclosed plastic strap in the form of connection joints for the fabric suspension straps.

SUMMARY OF THE INVENTION

According to the invention, a disposable liner is provided to be removably secured to the forehead contacting portion or flap of protective head covering apparatus, such as hard hats, to cushion the contact with the forehead and provide for sweat absorption and insulation to thereby increase the comfort in wearing of the protective head covering apparatus. The disposable liner includes a piece of absorbent, cushioning material, such as terry cloth or sythetic, sponge backed, fabric material having a forehead contacting surface and an opposite, securement surface. Pressure sensitive adhesive covers the securement surface of the material so that the material may be removable secured to the forehead contacting flap of the protective head covering apparatus by means of such adhesive. The adhesive may take the form of double sided pressure sensitive adhesive tape applied to the securement surface of the material. The exposed surface of the pressure sensitive adhesive is covered with protective material, such as a coated paper, which can be easily peeled from the adhesive when it is desired to secure the material to the forehead contacting flap for use in the headcovering apparatus, but otherwise protects the adhesive during transport and storage of the liners prior to use.

The material is configured to substantially cover the surface of the forehead contacting flap of the head covering apparatus so as to cover all areas of contact between the flap and the wearer's forehead. The material also preferably covers the flap as it normally folds around forwardly of the head to provide good securement to the flap and prevent the edge of the material and adhesive thereon from coming in contact with a wearer's forehead when placing the head covering apparatus on the head so that the liner does not tend to peel off the flap. For this reason, the portion of the material which is folded over is preferably provided with a series of slits therein, such as four slits, to allow the material to be easily folded over and follow the contours of the flap.

THE DRAWINGS

In the drawings, which illustrate the best mode presently contemplated for carrying out the invention in actual practice:

FIG. 1 is a bottom perspective view of a hard hat showing a liner of the invention installed on the forehead contacting flap;

FIG. 2, a fragmentary vertical section taken on the line 2—2 of FIG. 1;

FIG. 3, a front elevation of a liner of the invention;

FIG. 4, a perspective view of the liner of FIG. 3, showing the liner partially folded and a portion of the adhesive protective material removed; and FIG. 5, a vertical section of the liner of FIG. 3, taken on the line 5—5 of FIG. 3.

DETAILED DESCRIPTION OF THE ILLUSTRATED EMBODIMENT

Figure 1:
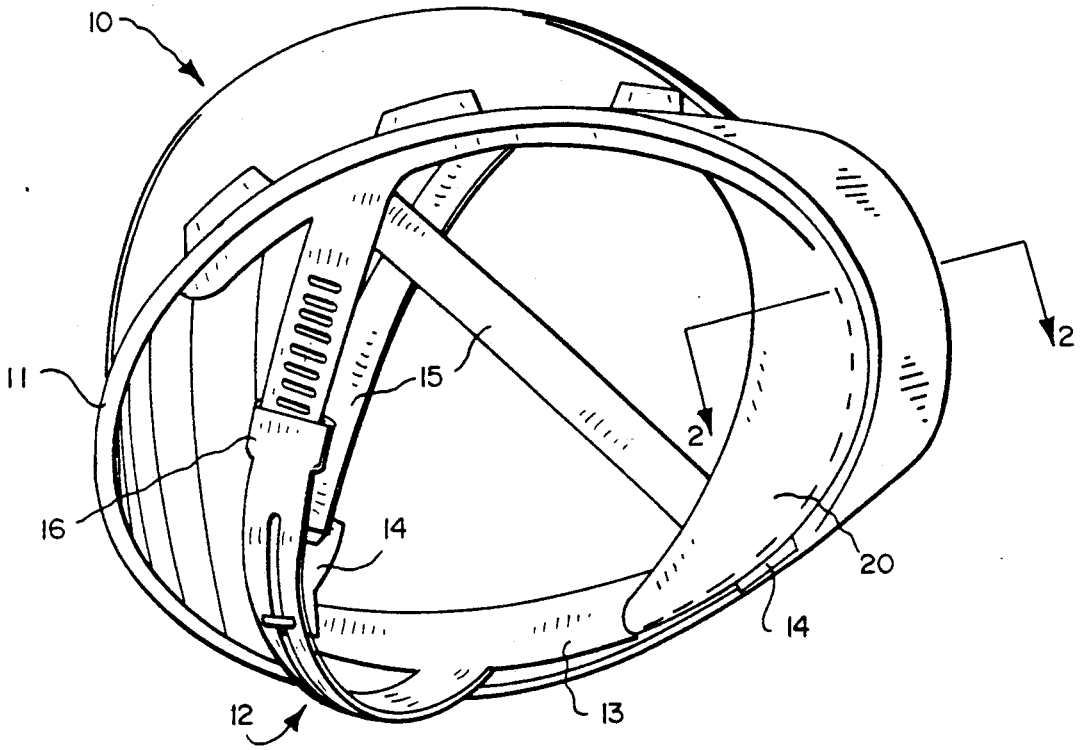
Figure 2:
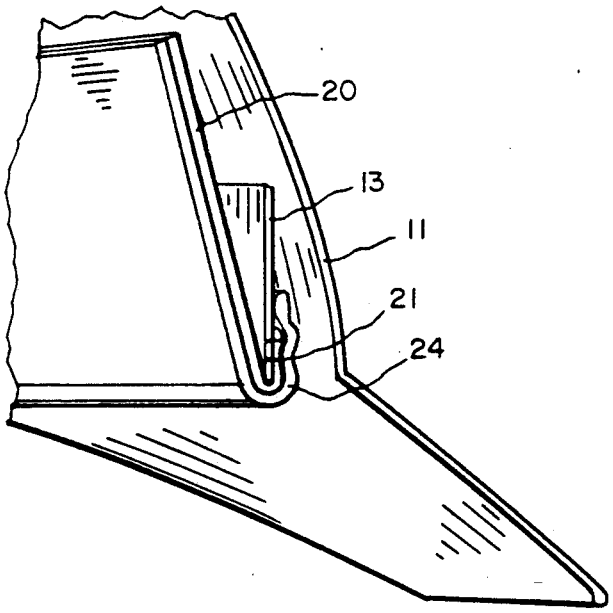

As shown in FIGS. 1 and 2, the normal hard hat 10 includes a protective hard shell 11 which is supported on a wearer's head by headgear 12 mounted inside the shell 11. The headgear 12 generally includes a strap 13 which is attached to the shell at several points as by resilient hinges 14 and extends around a wearer's head, and straps 15 with ends secured to strap 13 or to the attachment hinges 14 to extend over the top of the user's head to support the shell 11 thereover. The strap 13 generally has provisions for size adjustment, as at 16, so the strap can be sized to fit snugly around the forehead, sides, and back of the wearers head, above the ears, to hold the hat securely on the wearer's head. Since strap 13 extends snugly about the wearer's head, it is usually configured to fit comfortably against the users head, particularly across the users forehead. For this purpose, the front portion of strap 13 usually has a forehead contacting flap 20 secured to the outer side thereof, such as by stitching 21, and folded around the bottom of strap 13 approximately 180° to extend upwardly over the inner forehead contacting surface thereof. This forms a forehead contacting flap surface. The flap 20 is usually made of a foam backed plastic material to provide cushioning for the wearer's forehead.

While the foam backed plastic material usually used for flap 20 is an improvement over merely having strap 13 contact the forehead, since it is a plastic surface which contacts the forehead, it does not absorb persperation, and, in cold weather, it is cold when placed against the head. The invention provides a disposible liner 24 to be secured to the flap 20 to provide a more comfortable, persperation absorbing and insulating surface to contact the forehead. Since the liner is provided to absorb persperation, the liner must be easily removable and replaceable so that, particularly when used in hot environments, it can be replaced regularly and frequently.

The preferred embodiment of the liner 24 of the invention comprises a piece of terry cloth or other absorbent material 25, such as a sponge backed synthetic material, cut to a size and shape sustantially corresponding to the size and shape of flap 20. One surface of material 25 forms a forehead-contacting surface while the opposite surface is covered with a pressure sensitive adhesive 26, FIGS. 4 and 5, to enable the liner to be removably secured to flap 20. The pressure sensitive adhesive may be a coating of such adhesive that is sprayed, brushed, or otherwise applied to the surface of the liner material 25, or conveniently may take the form of double sided, pressure sensitive tape which is applied to the surface of the liner. It has been found that a double sided, pressure sensitive tape with a rubber based adhesive is satisfactory, such as type 400 tape made by 3-M corporation. The adhesive used with this type of tape remains easily removable from flap 20 and does not leave a sticky residue. Acrylic type pressure sensitive tape such as a double sided carpet tape may be used, but such tape tends to leave a sticky residue and is hard to remove after being in place on flap 20 for more than about two weeks.

Prior to use, the pressure sensitive adhesive 26 on material 25 is covered with a protective covering such as a coated paper 27 which covers adhesive 26 and protects it until time to apply the liner to flap 20. In manufacturing, the material forming the liner may be coated with adhesive as a large sheet and the adhesive protective paper placed thereover prior to cutting the liners from the larger sheet. The protective paper may include one or more cuts or scores therein as is common practice to facilitate removal of the paper from the adhesive on the liner.

Figure 3:
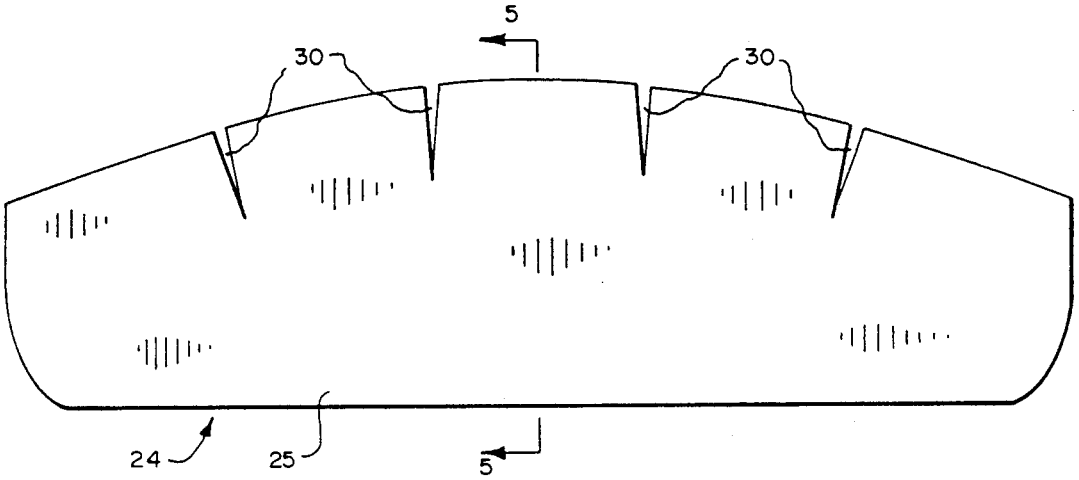
Figure 4:
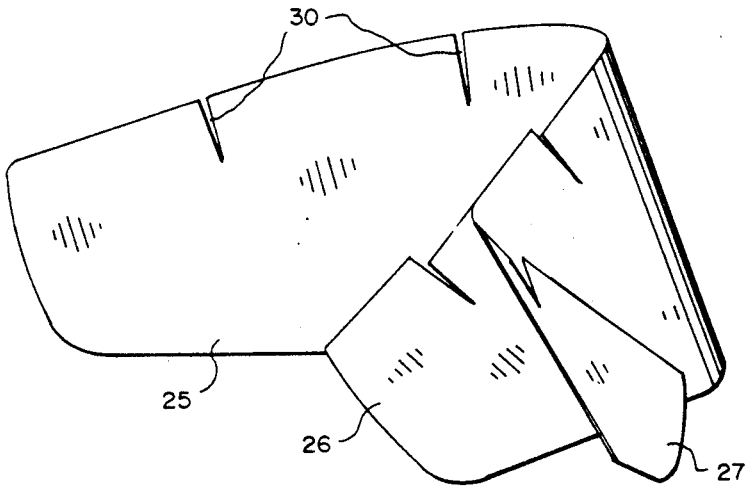
Figure 5:
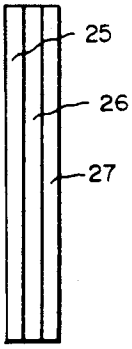

In order to use the liner, the adhesive protective material 27 is removed from the adhesive by peeling it from the adhesive as shown in FIG. 4. The liner is then applied to the headgear flap 20. The liner is provided with several slits or V-grooves along one edge thereof, such as V-grooves 30, FIGS. 3 and 4, to facilitate the bending of that edge of the liner around the folded back portion of flap 20, FIG. 2. The V-grooves are preferred because they eliminate overlapping of the folded fabric. After installation, the liner is firmly secured to flap 20 by adhesive 26 with the exposed surface of the liner forming a forehead contacting surface.

The embodiment of the liner illustrated is designed specifically to fit the forehead contacting flap of a hard hat manufactured by MSA. Other hard hat manufacturers use different shaped flaps or merely surround the front portion of the head encircling strap with a foam backed plastic which takes the place of the flap illustrated. Thus, the liner of the invention may take different shapes depending upon the head gear or protective head covering with which it is to be used. Thus, where merely a padded strap is used, the liner may be substantially rectangular.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A disposable liner for lining a forehead-contacting flap of a protective head covering such as a hard hat, said forehead-contacting flap having an inner forehead-contacting flap with a portion along a side thereof folded approximately 180°, and wherein the forehead-contacting flap has a forehead-contacting surface, comprising a piece of absorbent, cushioning material sized to fit over the forehead-contacting surface of the forehead-contacting flap of the protective head covering, said material having a forehead-contacting surface and an opposite surface; pressure sensitive adhesive covering the opposite surface so that the piece of material may be removably secured to the forehead-contacting surface of the forehead-contacting flap by placing the pressure sensitive adhesive against such flap, one edge of said material being adapted to be folded over the folded portion of the flap; slits in the side of said material adapted to be folded over the folded portion of the flap to facilitate such folding; and removable adhesive covering means covering the pressure sensitive adhesive to protect such adhesive until it is desired to adhere the piece of material to the forehead-contacting flap.

2. A disposable liner according to claim 1, wherein four slits are included.

3. A disposable liner according to claim 1, wherein the pressure sensitive adhesive is a double sided tape.

4. A disposable liner according to claim 3, wherein the double sided tape is a carpet tape.

5. A disposable liner according to claim 3, wherein the adhesive is a rubber based adhesive.

6. A disposable liner according to claim 5, wherein the rubber based adhesive is a type 400 adhesive manufactured by 3-M Corporation.

7. A disposable liner according to claim 1, wherein the adhesive is a rubber based adhesive.

8. A disposable liner according to claim 7, wherein the rubber based adhesive is a type 400 adhesive manufactured by 3-M corporation.

9. A disposable liner according to claim 1, wherein the absorbent, cushioning material is terry cloth.

10. A disposable liner according to claim 1, additionally including slits therein placed so as to facilitate fitting of the liner around curves and folds of the forehead contacting flap to which it is applied.

11. A disposable liner according to claim 1, wherein the material is sized to substantially correspond in size to the forehead contacting flap.

12. A disposable liner for lining a forehead-contacting portion of headgear supporting a protective shell of a protective head covering such as a hard hat, wherein the forehead-contacting portion of the headgear is spaced from the protective shell and has an inner forehead-contacting surface and an outer surface, comprising a piece of absorbent, cushioning material sized to have a portion thereof fit over the inner forehead-contacting surface of the forehead-contacting portion of the headgear and a portion thereof folded over to fit at least partially over the outer surface of the forehead-contacting portion of the headgear, said material having a forehead-contacting surface and an opposite surface; slits in the portion of the material at least partially covering the outer surface of the forehead-contacting portion of the headgear to facilitate folding over of the material from the forehead-contacting surface to the outer surface of the headgear; pressure sensitive adhesive covering the opposite surface so that the piece of material may be removably secured to the forehead-contacting surface and the outer surface by placing the pressure sensitive adhesive against such surfaces; and removable adhesive covering means covering the pressure sensitive adhesive to protect such adhesive until it is desired to adhere the piece of material to the forehead-contacting portion of the headgear.

13. A disposable liner according to claim 12, wherein four slits are included.

14. A disposable liner according to claim 13, wherein the portion of the material fitting over the forehead-contacting surface is sized and shaped to substantially correspond with the size and shape of such surface.

15. A disposable liner according to claim 12, wherein the pressure sensitive adhesive is a rubber based adhesive.

16. A disposable liner according to claim 15, wherein the pressure sensitive adhesive is a type 400 adhesive manufactured by 3-M Corporation.

17. A protective headcovering, comprising a protective shell; headgear supporting the protective shell, the headgear including a forehead-contacting portion spaced from the protective shell, the forehead-contacting portion of the having an inner forehead-contacting surface and an outer surface; a piece of absorbent, cushioning material sized to fit over the inner forehead-contacting surface of the forehead-contacting portion of the headgear, and having a portion thereof folded over to fit at least partially over the outer surface of the forehead-contacting portion of the headgear; said material having a forehead-contacting surface and an opposite surface; slits in the portion of the material at least partially covering the outer surface of the forehead-contacting portion of the headgear to facilitate folding over of the material from the inner forehead-contacting surface to the outer surface of the forehead-contacting portion of the headgear; and pressure sensitive adhesive covering the opposite surface of the material whereby the material may be removably secured to the forehead-contacting surface and at least a portion of the outer surface of the headgear.

18. A protective headcovering according to claim 17, wherein four slits are provided in the portion of the material folded over to fit at least partially over the outer surface of the forehead-contacting portion of the headgear.

19. A protective headcovering according to claim 17, wherein the portion of the material fitting over the forehead-contacting surface is sized and shaped to substantially correspond with the size and shape of such surface.

20. A protective headcovering according to claim 17, wherein the pressure sensitive adhesive is a rubber based adhesive.

* * * * *